United States Patent [19]

Suzuki et al.

[11] Patent Number: 4,574,817

[45] Date of Patent: Mar. 11, 1986

[54] CORK KNIFE CLEANING APPARATUS

[75] Inventors: Minoru Suzuki, Tokyo; Masahiro Tamaribuchi, Fukuoka, both of Japan

[73] Assignee: The Japan Tobacco & Salt Public Corporation, Tokyo, Japan

[21] Appl. No.: 583,580

[22] Filed: Feb. 24, 1984

[30] Foreign Application Priority Data

Apr. 5, 1983 [JP] Japan ..... 58-58606

[51] Int. Cl.[4] ..... A24C 5/56; A24C 5/58; B26D 7/08

[52] U.S. Cl. ..... 131/94; 131/95; 83/168

[58] Field of Search ..... 131/94, 95; 83/168

[56] References Cited

U.S. PATENT DOCUMENTS 1,338,157 4/1920 Rains ..... 83/168

1,744,006 1/1930 Laws ..... 83/168

*Primary Examiner*—V. Millin

[57] ABSTRACT

A cork knife cleaning apparatus for cigarette filter attaching machine in a cork paper cutting apparatus is provided. The apparatus has a rotating drum which has cork knives projecting from the circumference of the same, receiving drum arranged to work with the rotating drum whereby a continuous tape of cork paper applied with paste on one side is cut into a desired length by pressing a cork knife against the tape paper, and has a cork knife cleaning apparatus comprising rotating brushes to clean the blades of the cork knives, an oil injecting nozzle having a plurality of oil injecting ports over the entire width of the nozzle, an oil supply system connected to the oil injecting nozzle, and a compressed air supply system connected to the oil injecting system, whereby the rotating brushes are uniformly sprayed with atomized oil. Therefore, the blades of cork knives can be clean, removing foreign substances which attach to as a result of cutting the pasted cork paper, and this maintains the cutting performance of the knives for long period time.

7 Claims, 3 Drawing Figures

CORK KNIFE CLEANING APPARATUS

BACKGROUND OF THE INVENTION

This invention relates to a cork knife cleaning apparatus of cork paper cutter in the filter attaching machine for filter-tipped cigarettes.

The filter attaching machine for making filter-tipped cigarettes is equipped with a cork paper cutter, the cork paper being used for binding the filter and cigarette together.

The cork paper in the form of continuous rolled strip is cut to a predetermined length and used for the binding of filter and cigarette. In the filter attaching machine, a piece of filter is two times the final filter in length is inserted coaxially between the two cigarettes of each final length and the cut cork paper is wound around the filter and the cigarette ends cotacting each end of the filter for secure binding.

The cork paper cutter consists of a pair of rotating drums, i.e., a cutter drum with cork knives projecting from the circumference of the rotating drum and a receiving drum facing the cutter drum. The blades of the cork knives cut the cork paper between the two drums.

Before the process of cutting the cork paper, the surface of the paper facing the cork knife is applied with paste. The cork paper is held on the back surface by a carrier drum which has a suction means for secure holding of paper. The receiving drum also has a paper holding means utilizing suction and faces the cutter drum.

As the cork knife cuts the cork paper, the knife blads contacts the paste on the paper and is contaminated by it. The paste used in the cigarettes is the one which is water-soluble or hydrated and which does not mar cigarette's perfume and taste.

In the process of cutting paper not applied with paste, i.e., during the cutting of continuous strip of paper, it is well known that small particles of paper dust attach to the knife blade. The knife blade is further contaminated when cutting the pasted paper.

To prevent contamination of the cork knife blade and maintain its cutting performance and also to prevent contamination of cigarettes or uneven cuts at the cigarette ends, it has been a common practice to stop the machine and clean the knife blade at appropriate times or provide a brush contacting the blade to clean away any contaminating substances during operation. In recent years, a brush applied with olive oil is installed in the path of knife blade to keep it clean.

That is, as the cork knife rotates, the cork knife is wiped clean by the brush containing oil. It is important to apply an adequate amount of oil to the brush. Too much oil will result in the cigarettes being contaminated with oil and too little oil will result in poor cutting performance. Thus, the brush is required to be supplied with an appropriate amount of oil for certain intervals of time.

It is verified that the adequate amount of oil to be supplied is about 2 cc for every 30 minutes. It is also important that the oil should be applied uniformly over the entire width of brush. There has been a demand for automating the oil supply work, but spreading oil uniformly is difficult and has been done manually. That is, the worker removes the rotating brush at certain intervals of time to apply an adequate amount of oil uniformly over the brush. This work, however, is dangerous if perfomed during operation and workers are not willing to do this job because their hands are fouled with oil. The manual oil application also has a possibility of fouling the products, too.

SUMMARY OF THE INVENTION

The object of this invention is to provide an apparatus which automatically supplies oil to the brush contacting the blade of cork knife.

Another object is to provide an apparatus which applies the small amount of oil uniformly over the entire width of the brush.

Still another object is to provide a cork knife cleaning apparatus which keeps the knife blade from being contaminated for long period by cleaning the blade with a brush which is automatically supplied with oil.

In the cork paper cutter of the cigarette filter attaching machine, the cork knife cleaning apparatus of this invention comprises: a rotating brush to clean the blade of the cork knife, an oil injecting nozzle having a plurality of openings against over the width of the brush from which to inject oil, an oil supply means communicated with the oil injecting nozzle, and a compressed air supply means communicated with the oil injecting nozzle, whereby the oil is sprayed through the nozzle against the brush which cleans the knife blade.

DETAILED DESCRIPTION OF THE EMBODIMENTS

The present invention will be explained by taking up a preferred embodiment of the drawings.

Figure 1:
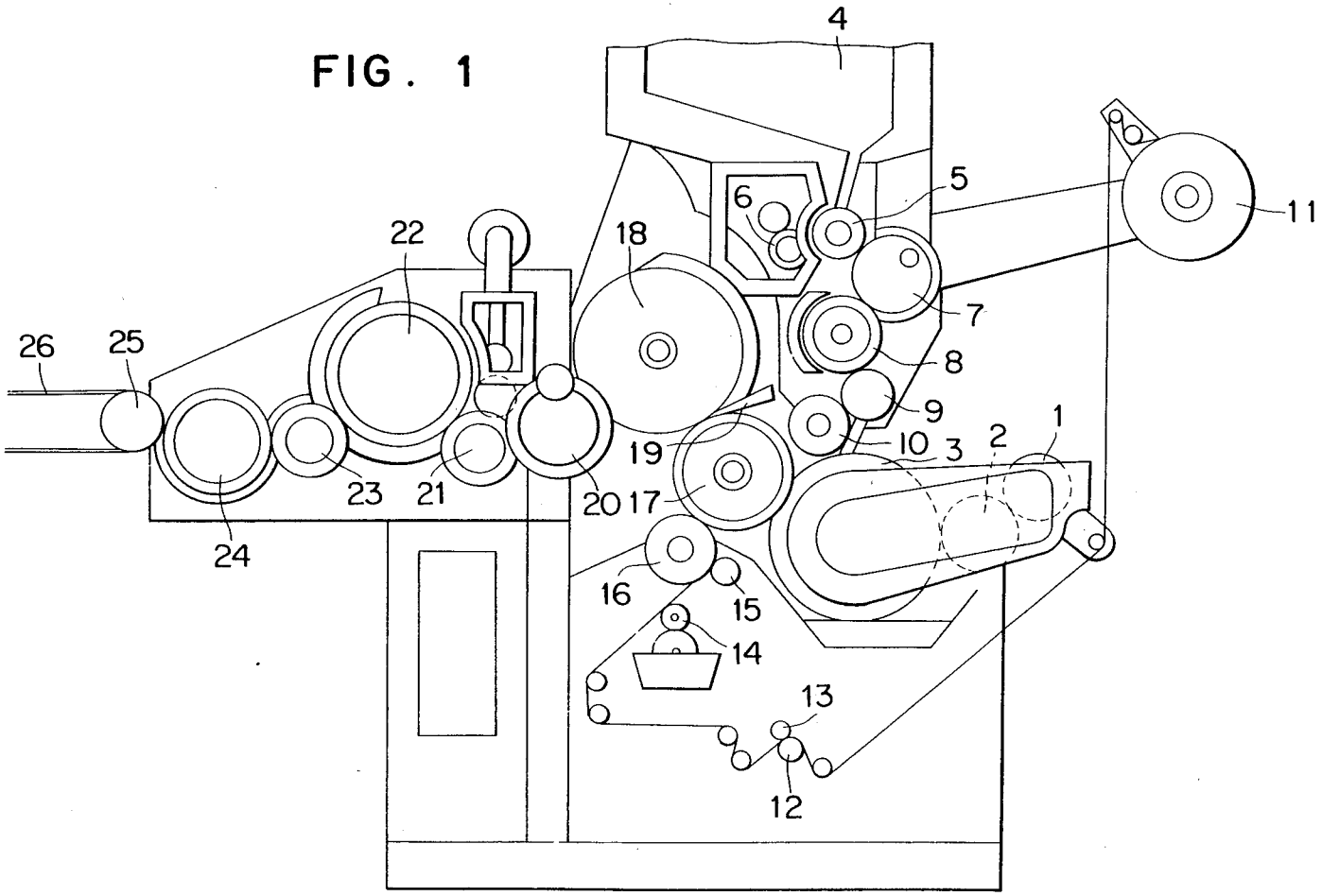
FIG. 1 is a front view of the filter attaching machine equipped with the cork knife cleaning apparatus of this invention.

After being rolled from shredded tobacco into a continuous cigarette bar and cut to a predetermined length by the cigarette making machine, the cigarettes are transferred to the filter attaching machine where they are attached with a filter. FIG. 1 shows an example of filter attaching machine.

The cigarettes transferred from the cigarette making machine are accepted by the receiving drum 1. The drum 1 has rescesses on the circumferences of the cylindrical surface extending along the axis thereof to accept and carry the cigarettes. The cigarettes are transferred from the drum 1 onto similar recesses formed on the successive drums for further processing.

The receiving drum 1 transfers cigarettes to a pair of cigarette aligning drums 2 which have alternate recesses staggered thereon to each other. The cigarette aligning drums 2 align the staggered cigarettes into an every single line of paired cigarettes, the pair of cigarettes being arranged in a line with a gap between them. The aligned cigarettes are further carried on to the assembly drum 3.

A filter bar is sent to the cutter drum 5 where it is cut by two round knives 6 to form filter chips of a length two times the final filter length. The filter chips are arranged into a line of staggered filter chips by a filter aligning drum 7 consisting of three rings. The aligned filters are then arranged inside the displacing drum 8 and then transferred through a first intermediate drum 9 and a second intermediate drum 10 into the gap between cigarettes on the assembly drum 3.

A set of two cigarettes and a filter arranged in a line is transferred from the assembly drum 3 to the transfer drum 17 where the three pieces are axially put closer together.

The cork paper is drawn out from the paper reel 11 by the feed roller 12 and receiving roller 13. The paper is then pasted by the pasting device 14 and carried by a suction drum 16. At the same time the paper is cut by the cutter device 15 to a predetermined length. The cutter device 15 will be detailed later.

The cut cork paper is pasted and wound around the set of cigarettes and filter on the paper rolling drum 18 by the roll hand 19. The cut cork paper is longer than the filter chip. The filter chip is put on the center of the paper length with the ends of two cigarettes contacting the filter ends and these are rolled with paper into a single cigarette bar.

The cigarette bar of a length two times the final filter-tipped cigarette undergoes an air tightness check by the check drum 20 and then is cut by the cutting drum 21 at the center of the filter to form two filter-tipped cigarettes. These two filter-tipped cigarettes have their filters facing each other on the cutting drum 21. One of the opposingfilter-tipped cigarettes is turned by a reversing drum 22 so that they are oriented in the same direction and aligned in a single line of filter-tipped cigaretts.

The filter-tipped cigarettes are carried through an intermediate durm 23 and a check drum 24 and then discharged onto the conveyor belt 26 by the discharge drum 25.

Figure 2:
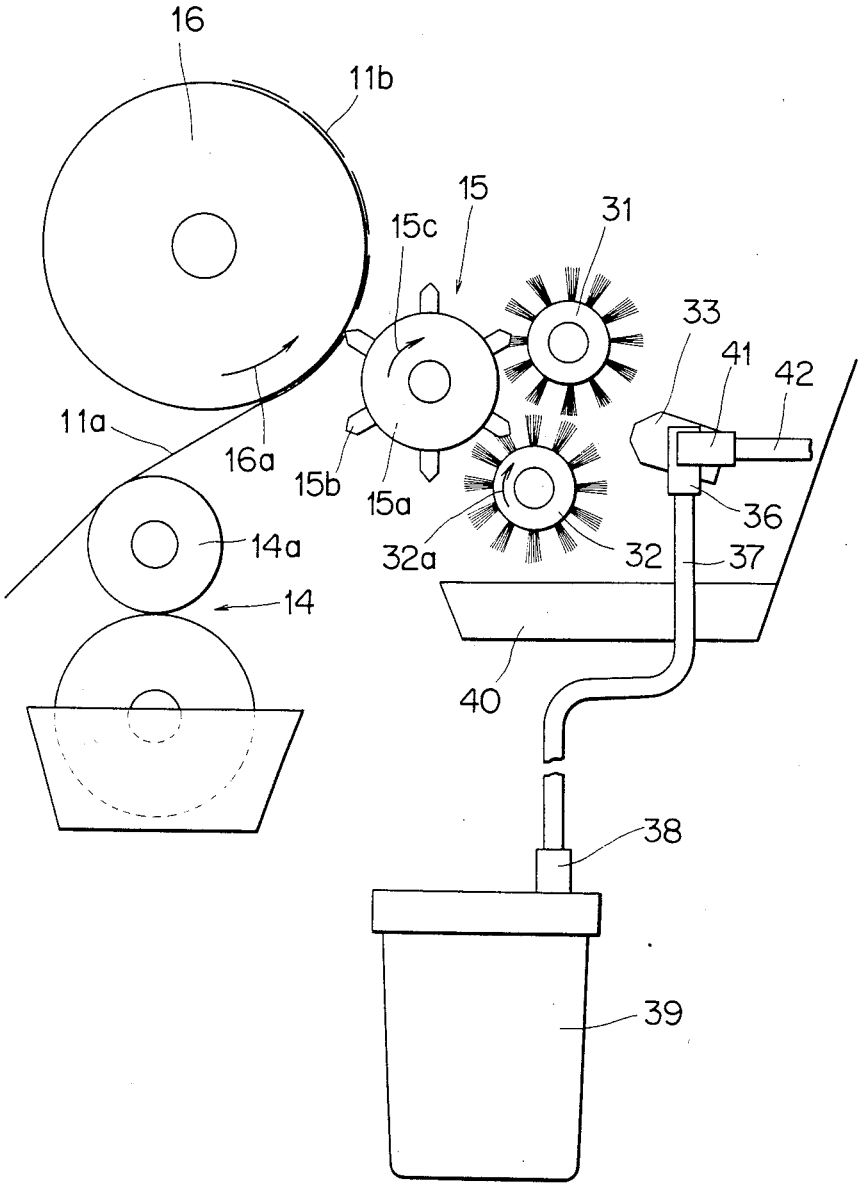
FIG. 2 is a front view of a perferred embodiment of this invention.

Referring to an enlarged view of the cutting apparatus in FIG. 2, continuous tape of the cork paper 11*a* drawn out from the roll 11 is fed through the pasting device 14 and a cutting device 15.

The pasting roller 14*a* of the pasting device 14 has its roller surface applied with paste which is transferred onto the cork paper 11*a*.

The suction drum 16 for receiving said continuous tape of paper therearound has small openings on its cylindrical surface and a vacuum means (not shown) communicating with these openings. The suction drum 16 holds by suction the surface of the cork paper 11*a*, a side not coated with paste, and rotates in the direction of arrow 16*a* to carry the cork paper 11*a*.

A cutter drum 15*a* is arranged closed to the suction drum 16 to work therewith in facing relation thereto such that said two drums have axes parallel to each other. Said cutter drum 15*a* has cork knives 15*b* (six in the example shown) projecting around its circumference. The knife blade has a width sufficient to cut the cork paper 11*a* and is arranged so that its edge contacts the surface of the suction drum 16. The cutter drum 15*a* rotates in the direction of arrow 15*c* at the same speed as the suction drum 16 while cutting the paper into individual pieces of cork paper 11*b*. The interval of the cork knives 15*b* is set according to the length to which the cork paper is to be cut. The number of knives and the diameter of the cutter drum can be determined according to varous requirements.

A pair of brush rolls 31 and 32 for cleaning blades of the cork knives 15*b* are arranged in facing relation to said rotating drum 16 such that the four drums have axes parallel to each other.

The brush roll 31 is a freely rotatable roll supported on the axis and is rotated by the contact with the cork knife 15*b*. The other brush roll 32 is rotated in the direction of arrow 32*a* to forcibly wipe the front surface of the cork knife 15*b*. These two brush rolls 31 and 32 are arranged close together so that the brush tips contact each other.

Figure 3:
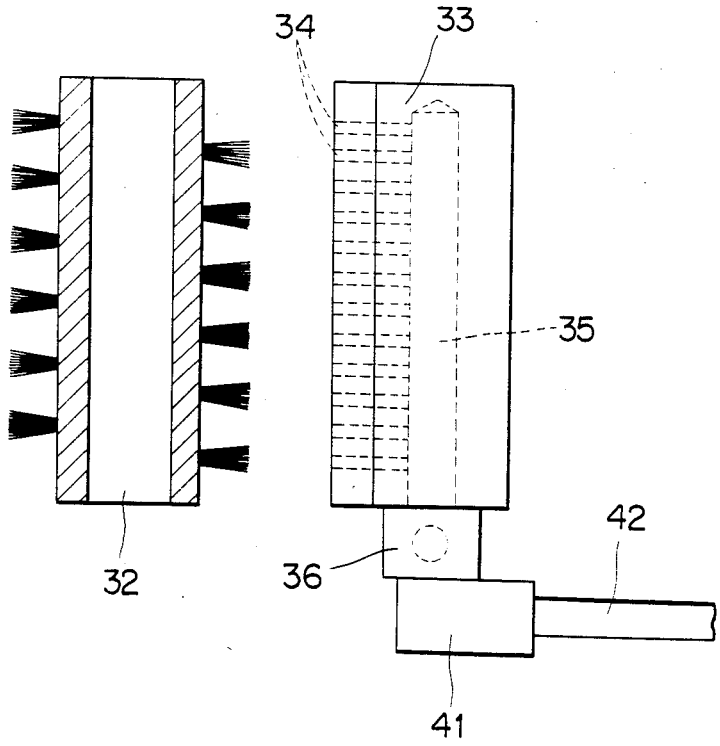
FIG. 3 is a plan view of essential part of FIG. 2 including a cross sectional view of brush roll.

As shown in FIGS. 2 and 3, and oil injection nozzle 33 is arranged to be directed toward the brush roll 31. The nozzle 33 has a width spanning over the entire width of the brush rolles 31, 32 and has a number of laterally arranged oil injecting ports 34. The oil injecting ports are preferably directed tangent to the brush hair tips of the brush rolls 31, 32.

The oil injecting ports 34 are branched from the passage 35 which is connected to the oil supply system through an oil pipe joint 36 and to an air supply system through an air pipe joint 41.

The oil supply system has an oil pump 39 which supplies oil to the nozzle through the oil pipe 37. The oil pipe 37 has joints 36 and 38 at its ends. The oil pump 39 is of plunger type, which is well known, and is actuated by the operation of the filter attaching machine to deliver a predetermined amount of oil at certain intervals.

The air supply system has a compressed air source which is connected to the nozzle through an air pipe 42 communicating with the air pipe joint 41.

In the embodiment shown, 2 cc of olive oil is delivered by the pump for every interval of 30 minutes. Compressed air of 0.2 $kg/cm^2$ is also supplied to the oil injecting nozzle 33 which consists of 12 lateral oil injecting ports 34 each 0.5 mm in diameter, to atomize the oil to be sprayed against the brush hair. Denoted 40 is a pan for receiving falling oil.

As is seen from the foregoing, the brush rolls which are uniformly sprayed with atomized oil can clean the blade of cork knife, removing foreign substances that attach to the knife blade as a result of cutting the pasted cork paper, and this maintains the cutting performance of the knife for long period of time.

What is claimed is:

1. A cork knife cleaning apparatus for cigarette filter attaching machine in a cork paper cutting apparatus comprising a rotating drum which has a plurality of, cork knives projecting from circumferential portions thereof;

a suction drum for receiving a continuous tape of paper therearound and arranged in facing relation to said rotating drum to work with said rotating drum such that said two drums have axes parallel to each other, each knife pressing against said rotating drum to cut said continuous tape of paper into a plurality of pieces of paper;

a pair of brush rolls for cleaning blades of said cork knives, said brush rolls being arranged in facing relation to said rotating drum such that said four drums have axes parallel to each other;

oil injecting means for injecting oil against said two brush rolls; and compressed air supply means connected to said oil injecting means such that oil is atomized to be sprayed against said cork knives.

2. A cork knife cleaning apparatus according to claim 1, wherein one of said brush rolls in freely rotatbly supported on an axis thereof to be rotated by contact with said cork knives.

3. A cork knife cleaning apparatus according to claim 1, wherein the other of said brush rolls is rotated to wipe forcibly a front surfaces of the cork knives.

4. A cork knife cleaning apparatus according to claim 1, wherein said oil injecting means includes a nozzle, said nozzle having oil injecting ports, a passage connected to said oil injecting ports and oil pipe joint communicating said compressed air supply means and said passage therethrough.

5. A cork knife cleaning apparatus according to claim 4, wherein said oil injecting ports are directed tangent to brush hair tips of said brush rolls.

6. A cork knife cleaning apparatus according to claim 4, wherein said oil injecting ports are arranged widely over a lateral width said brush rolls respectively.

7. A cork knife cleaning apparatus according to claim 4, wherein said compressed air supply means has a compressed air source, air pipe and an air pipe joint, said compressed air source being connected to said air passage through said air pipe communicating with said air pipe joint.

* * * * *